United States Patent [19]

Puretic

[11] 4,223,625

[45] Sep. 23, 1980

[54] OUTBOARD THRUSTER FOR BOATS

[76] Inventor: Mario J. Puretic, 259 6th Ave. North, Monte Cristo Isle, Tierra Verde, Fla. 33715

[21] Appl. No.: 869,847

[22] Filed: Jan. 16, 1978

[51] Int. Cl.[2] ..... B63H 25/42

[52] U.S. Cl. ..... 114/147; 440/61; 440/62

[58] Field of Search ..... 9/39; 115/35, 18 R, 115/18 A, 18 E, 17, 37, 38, 41 R; 114/147; 254/138, 188, 150 FH; 212/8 R, 65; 214/75 H, 86 R; 187/6, 95; 414/540, 560

[56] References Cited

U.S. PATENT DOCUMENTS

| | | | |
|---|---|---|---|
| 1,199,803 | 10/1916 | McDougall | 115/35 X |
| 2,023,258 | 12/1935 | Young | 9/39 |
| 2,498,299 | 2/1950 | Rissler | 187/95 |
| 2,987,027 | 6/1961 | Wanzer | 115/38 X |
| 2,996,195 | 8/1961 | Hansen | 212/8 R |
| 3,034,767 | 5/1962 | Gordon | 254/138 |
| 3,251,330 | 5/1966 | Honegger | 114/147 |

*Primary Examiner*—Sherman D. Basinger
*Attorney, Agent, or Firm*—Fulwider, Patton, Rieber, Lee & Utecht

[57] ABSTRACT

An outboard thruster for use in maneuvering a marine vessel at low speeds, particularly during docking or fishing operations. The apparatus includes a motor-propeller unit which is normally stowed aboard a vessel. The motor-propeller unit is lowered into a submerged position adjacent and outboard the vessel's bow to effect slow speed maneuvering of such vessel. When submerged, the direction of thrust produced by the motor-propeller unit can be controlled.

4 Claims, 9 Drawing Figures

OUTBOARD THRUSTER FOR BOATS

BACKGROUND OF THE INVENTION

Marine vessels have heretofore been provided with integral bow or side thrusters to improve the maneuvering thereof during stationary slow speed operations, such as docking or fishing. Such thrusters include a tunnel formed athwartship in the vessel within which is mounted a propeller. Power is transmitted to the propeller from a source disposed within the vessel's hull. Such heretofore proposed thrusters are expensive to install, create considerable drag during forward movement of the vessel and are difficult to maintain. Moreover, such thrusters are subject to marine growth. Additionally, since such heretofore proposed thrusters are located below the waterline they cannot be repaired or otherwise maintained except when the vessel is in drydock.

SUMMARY OF THE INVENTION

It is a major object of the present invention to provide outboard thruster apparatus for use with a marine vessel which eliminates the aforedescribed disadvantages of conventional permanently mounted thrusters. The outboard thruster apparatus of the present invention is stowed aboard the vessel when not in use and is lowered to a submerged operative position only when the use thereof is necessitated.

A further object of the present invention is to provide outboard thruster apparatus of the aforedescribed nature which is economical of construction and may readily be mounted on vessels of various sizes.

Yet a further object of the present invention is to provide outboard thruster apparatus of the aforedescribed nature which is readily accessible for servicing without requiring that the vessel upon which it is mounted be drydocked.

Yet an additional object of the present invention is to provide outboard thruster apparatus of the aforedescribed nature utilizing a motor-propeller propulsion unit which is controllable to direct the thrust produced thereby in different horizontal directions relative to the vessel.

It is a more particular object of the present invention to provide outboard thruster apparatus of the aforedescribed nature which includes mounting means associated with the bow area of the vessel, a propulsion unit carried by a support, with the support being associated with the mounting means to permit the support to undergo vertical movement relative to the vessel's bow area from a raised, non-operative position to a submerged, operative position, with hoisting means interconnecting the support and the vessel.

Another object of the present invention is to provide outboard thruster apparatus of the aforedescribed nature which requires only minor modification of the vessel with which it is utilized.

Other objects and advantages of the present invention will become apparent from the following detailed description taken in conjunction with the accompanying drawings.

DESCRIPTION OF THE PREFERRED EMBODIMENTS

Figure 1:
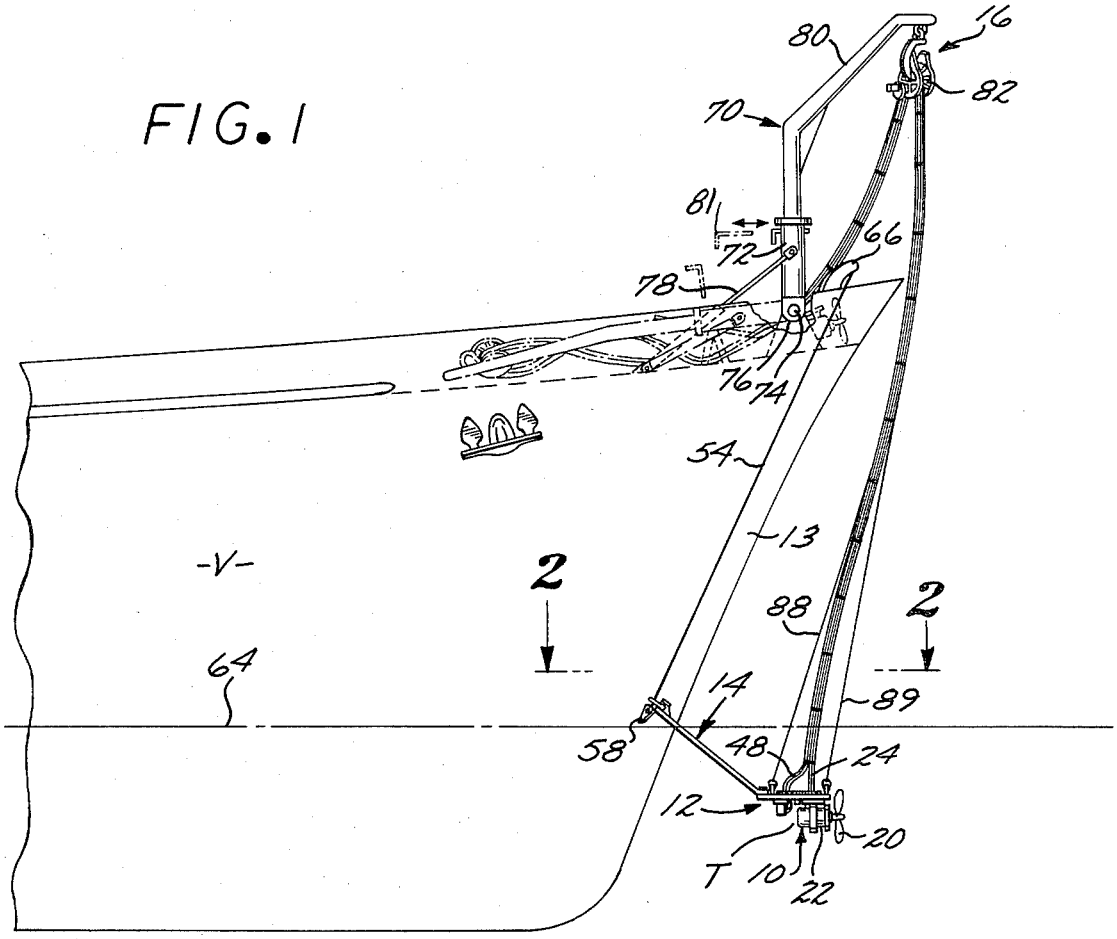
FIG. 1 is a broken side elevational view of the bow area of a marine vessel provided with a first form of outboard thruster apparatus embodying the present invention.

Referring to the drawings, and particularly FIGS. 1–5 thereof, there is shown a marine vessel V provided with a first form of outboard thruster apparatus T embodying the present invention. Such outboard thruster apparatus T generally includes a power-driven propulsion unit, generally designated 10, carried by support means, generally designated 12, with such support means in turn being connected to mounting means, generally designated 14, associated with the bow area 13 of the vessel V. Hoisting means, generally designated 16, are mounted adjacent the bow of vessel V for lowering the support means 12 and its propulsion unit 10 from a normally inoperative, stowed position on the deck of the vessel V to a submerged, operative position shown in solid outline in FIG. 1.

More particularly, the marine vessel V may be of any size and is of generally conventional construction utilizing a main power plant coupled to one or more screws (not shown). The power-driven propulsion unit 10 of the outboard thruster apparatus T includes a propeller 20 which is drivingly coupled to a suitable motor, such a conventional hydraulic motor 22. Preferably such motor 22 is reversible. The motor 22 is attached to hydraulic power lines 24. The rear end of support means 12 is carried by the mounting means 14, while the propulsion unit 10 depends from the front portion of such support means.

Figure 3:
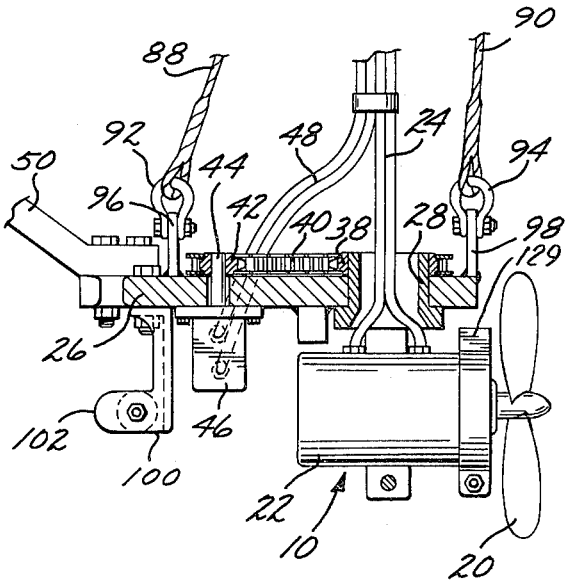
FIG. 3 is a vertical sectional view taken in enlarged scale along line 3—3 of FIG. 4.

Referring particularly to FIG. 3, support means 12 include a generally triangular support plate 26 which rotatably supports at its front portion a collar 28 having a pair of depending motor straps 30 and 32 provided at their lower ends with a bolt and nut combination 34. The upper portion of collar 28 is keyed to a sprocket 38. Sprocket 38 receives a chain 40 the rear end of which is engaged with a second sprocket 42 which is keyed to the shaft 44 of a steering motor 46. Such steering motor 46 may take the form of a conventional hydraulic motor coupled to hydraulic power lines 48.

Figure 2:
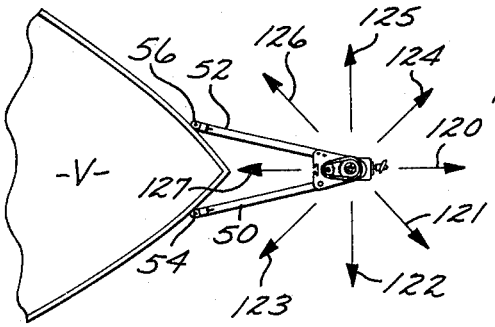
FIG. 2 is a horizontal sectional view taken along line 2—2 of FIG. 1.

The rear end of support plate 26 is rigidly affixed to the front end of a pair of like arms 50 and 52 which extend rearwardly and outwardly at an upwardly sloping angle relative to the bow area of vessel V, as shown particularly in FIGS. 1 and 2, such arms forming a part of mounting means 14.

Figure 5:
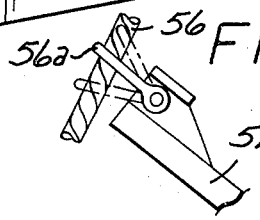
FIG. 5 is a vertical sectional view taken along line 5—5 of FIG. 4.
Figure 6:
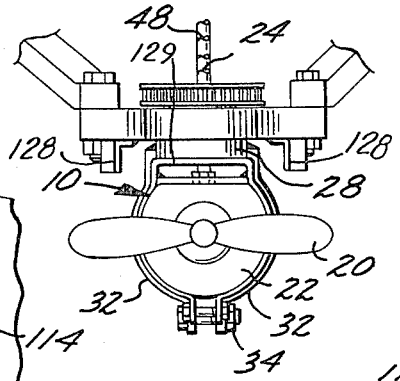
FIG. 6 is a vertical sectional view taken along line 6—6 of FIG. 4.

Mounting means 14 also include a pair of generally vertically extending guide cables 54 and 56, each disposed on opposite sides of the bow area 13 of vessel V. The lower ends of guide cables 54 and 56 secured to brackets 58 and 60, respectively, which are in turn rigidly affixed as by welding to the sides of the hull of vessel V just above the vessel's waterline 64. Such welding may be accomplished without drydocking vessel V. The upper ends of guide cables 54 and 56 are rigidly suspended from a pair of cable carriers 66 and 68 which have their rear ends rigidly affixed to the rail of the vessel V, from which point of attachment they extend forwardly and inwardly relative to the vessel's bow area 13. It should be understood that turn buckles or the like (not shown) may be interposed between the cables 54 and 56 and their respective cable carriers 66 and 68 in a conventional manner. Referring now to FIG. 5, the rear ends of arms 50 and 52 are provided with conventional shackles 54*a* and 56*a* which respectively receive guide cables 54 and 56.

The hoisting means 16 includes a retractable davit, generally designated 70, mounted adjacent bow area 13 of vessel V. Davit 70 includes a barrel 72, the lower end of which is pivotally attached at 74 to a base mount 76 having its lower end rigidly affixed to the deck of vessel V. A conventional hydraulic power cylinder 78 is interposed between the intermediate portion of barrel 72 and the vessel deck, off-center of such deck. The davit barrel 72 rotatably carries an arm 80 which extends vertically and then forwardly as indicated in FIG. 1. Arm 80 is rotatable within barrel 40 under the control of a removable keeper pin 81. The free end of arm 80 carries a conventional hydraulically operated power block 82 which may be of the general construction disclosed in Mario J. Puretic U.S. Pat. No. 2,733,530, issued Feb. 7, 1956. The power block 82 receives the aforementioned hydraulic power lines 24 and 48 as well as a pair of hoisting lines 88 and 90, the lower ends of which are secured to the front and rear portions of support plate 26 by means of shackles 92 and 94, as shown particularly in FIG. 3. The upper ends of hoisting lines 88 and 90 are secured to the deck of vessel V in a conventional manner. Shackles 92 and 94 are in turn removably secured to upstanding eyes 96 and 98 having their lower ends welded to the upper surface of support plate 26.

Figure 4:
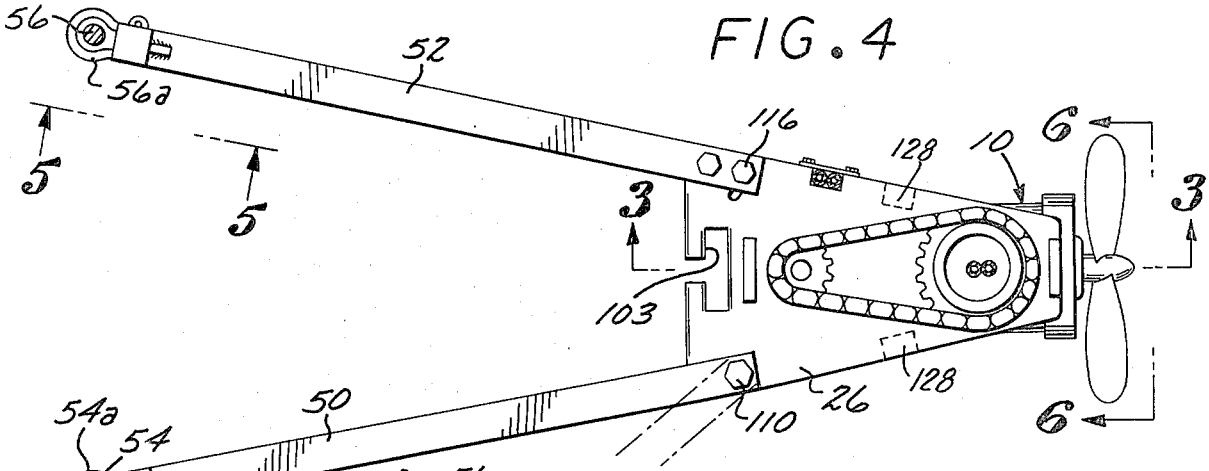
FIG. 4 is a top plan view of a propulsion unit and its support forming a part of said outboard thruster apparatus.

With further reference to FIG. 3, it should be noted that the underside of the rear portion of support plate 28 is formed with a depending arm 100, the upper end of which is rigidly bolted to support plate 26 and the lower end of which carries a guide roller 102 for a purpose to be described hereinafter. Referring now to FIG. 4, it will also be noted that a T-shaped slot 103 is formed in the rear portion of support plate 26 also for a purpose to be described hereinafter.

Figure 7:
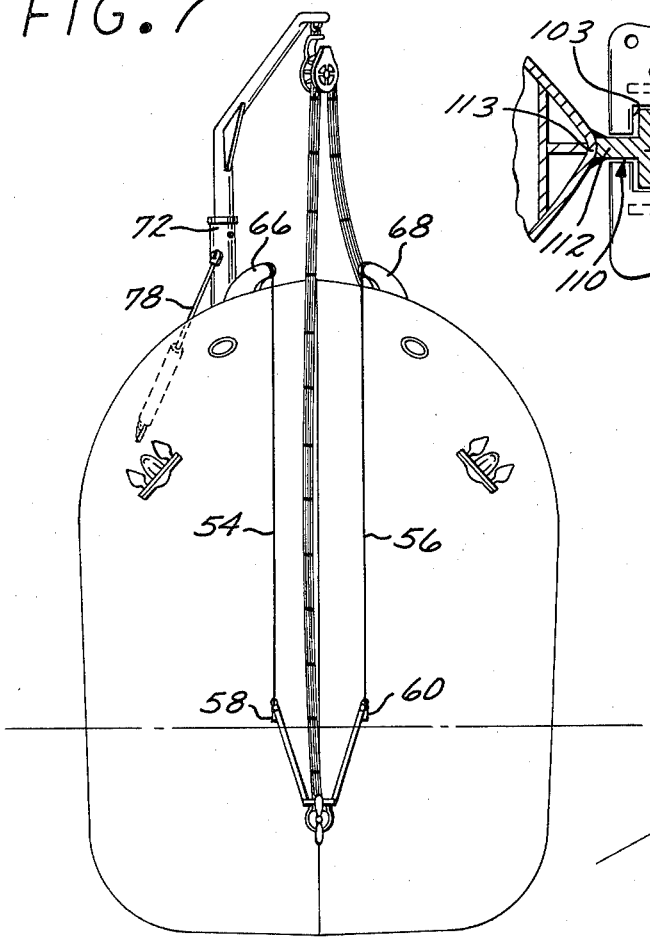
FIG. 7 is a front elevational view of the marine vessel of FIGS. 1 and 2.

In the operation of the aforedescribed outboard thruster apparatus T, the support means 12 and its associated parts including the motor-propeller unit 10 will be stowed on deck in the dotted outline position indicated in FIG. 1. In this regard, the davit may be pivoted rearwardly and to one side by the aforedescribed hydraulic power cylinder 78 to a retracted position. When the outboard thruster apparatus is to be utilized, the rod of the power cylinder 78 will be extended so as to raise the davit to its solid outline upright operative position of FIGS. 1 and 7. At this time, the hydraulic power lines 24 and 48 and the hoisting lines 88 and 90 will extend through the sheave of the power block 82. Additionally, the shackles 54*a* and 56*a* will be engaged with their respective guide cables 54 and 56. Thereafter, support means 12 and its associated parts will be lowered into their position of FIG. 1, wherein the motor-propeller unit 10 is submerged below waterline 64. At this time, the shackles 54*a* and 56*a* will rest upon the brackets 58 and 60. The outboard thruster apparatus T will then be in condition for operation.

Such operation is effected by transmitting hydraulic fluid under pressure through power lines 24 to hydraulic motor 22, thereby effecting rotation of propeller 20. The direction of thrust imparted by such propeller may be controlled by means of the aforedescribed hydraulic steering motor 46. In this regard, it should be understood that the rotation of the shaft 44 of such motor is controlled by means of suitable valving (not shown) interposed between hydraulic power lines 48 and a source of hydraulic power (not shown) in a conventional manner. Such control of the thrust produced by propeller 20 is indicated by the directional arrows shown in FIG. 2. Referring thereto, should it be desired to effect forward motion of the vessel V by means of the outboard thruster apparatus, the motor-propeller unit will remain centered relative to support plate 26, thereby imparting forward thrust represented by directional arrow 120. Should, however, it be desired to pull the bow of the vessel V in a clockwise direction, the steering motor 46 will be actuated so as to rotate its shaft 44 and thereby sprockets 42 and 38, collar 28 and motor-propeller unit 10 in a clockwise direction whereby the propeller 20 will impart thrust in a direction indicated by directional arrow 121. Further clockwise rotation of steering motor shaft 44 will cause the propeller 20 to impart thrust to the vessel in a manner indicated by directional arrows 122 and 123. The steering motor 46 may be operated in a similar manner to impart counterclockwise rotation to its shaft 44 to thereby cause the propeller 20 to exert thrust in the directions indicated by directional arrows 124, 125 and 126. The propeller may impart a rearward thrust to the vessel V as indicated by directional arrow 127 if the hydraulic motor 22 is operated in a direction reverse to its normal direction. Such reverse motor operation may be effected by suitable valving (not shown) in a manner well known to those skilled in the art. Rotation of motor-propeller unit 10 is limited by stops 128 depending from plate 26 and stop 129 on motor 22.

From the foregoing description, it will be apparent that the outboard thruster apparatus of the present invention will provide all the functions of conventional side or bow thrusters. In addition, it permits a vessel to be maneuvered in directions not possible with conventional thrusters. Such maneuverability is particularly important during docking. The outboard thruster of the present invention also finds particular use when employed by fishing vessels, particularly fishing vessels wherein the net is set, pursed and retrieved off the stern. During stern seining, it is desirable for the fishing vessel to maintain headway so as to insure that the net does not become entangled with the vessel's propeller or rudder. It is not economical to operate the vessel's main engine so as to obtain forward vessel movement by means of the vessel's propeller since such main engine has an excess of power. Additionally, there is great danger that the net will become entangled with the vessel's propeller. Where the outboard thruster apparatus of the present invention is utilized, however, the motor-propeller unit may be actuated so as to impart headway to the fishing vessel during stern seining operations.

Figure 9:
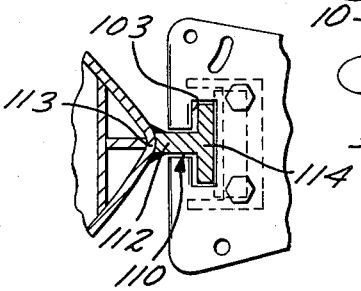
FIG. 9 is a horizontal sectional view of the mounting arrangement of FIG. 8.
Figure 8:
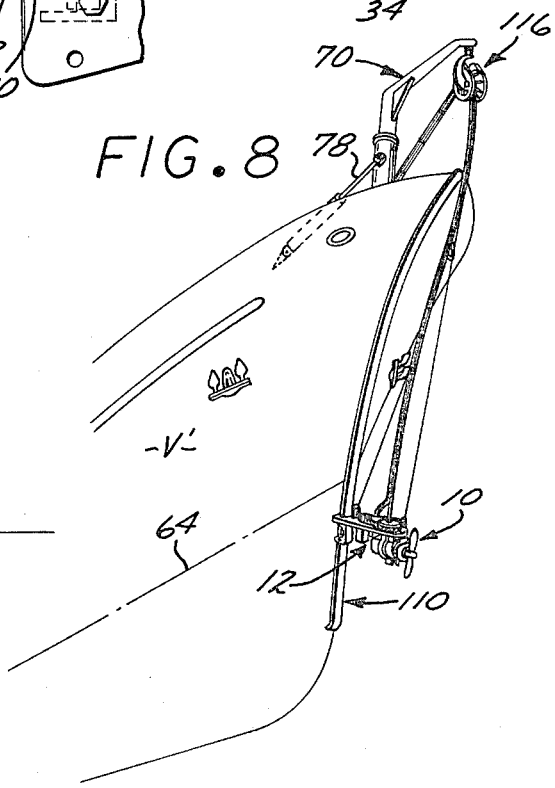
FIG. 8 is a broken perspective view of the vessel shown in FIG. 7, provided with a modified form of mounting arrangement for the outboard thruster apparatus of the present invention.

Referring now additionally to FIGS. 8 and 9, there is shown a modified form of mounting arrangement for the outboard thruster apparatus embodying the present invention. Such modified mounting arrangement substitutes a T-shaped track, generally designated 110, for the aforedescribed cable guides 54 and 56. Such T-track includes a leg 112, upon one end of which is integrally formed a head 114. The free end of leg 112 is rigidly affixed as by welding to the stern 113 of vessel V', as indicated particularly in FIG. 9. Such T-track extends from below the waterline 64 to a position adjacent the bow rail of vessel V', as indicated in FIG. 8.

The modified form of mounting arrangement of FIGS. 8 and 9 may be utilized with the same support plate 26 and associated parts shown in FIGS. 1–7 for use with either the mounting means 14 of these figures, or the T-track mounting means of FIGS. 8 and 9. Thus, in order to use the support plate 26 with the T-track of FIGS. 8 and 9, it is merely necessary to remove bolts 116 which secure the front end of arms 50 and 52 to the rear end of the support plate. The rear end of support plate 26 may then be dropped downwardly over the upper front end of T-track 110, with such T-track being slidably positioned within the T-shaped slot 103 formed in such support plate in the manner indicated in FIG. 9. The power block 82 may then be utilized to lower the hoisting lines 88 and 90 and hydraulic power lines 24 and 28 downwardly whereby support plate 26 and its associated parts will drop in a controlled manner under the influence of gravity to the submerged position adjacent the bow of vessel V', as shown in FIG. 8. It should be particularly noted that the roller 102 carried at the lower end of arm 100, shown particularly in FIG. 3, will engage the forward surface of the T-track 110 below support plate 26 to thereby assure that such track will not become jammed within T-slot 103. With the motor-propeller unit 10 submerged, the operation thereof will be the same as that described hereinbefore with respect to maneuvering of the vessel V'. When the motor-propeller unit 10 is no longer needed, power block 82 will be rotated so as to hoist support plate 26 and its associated parts over the upper end of T-track 100. Thereafter, davit arm 80 will be swung rearwardly and hydraulic cylinder 78 actuated so as to lower the davit and support plate 26 and its associated parts to the stowed position indicated in dotted outline in FIG. 1.

It should be particularly noted that the propulsion unit 10 is readily available for servicing either onboard the vessel or at a shoreside repair facility. Moreover, such propulsion unit may be readily replaced for more or less power, depending on the size and requirements of the vessel upon which it is installed. Although the aforementioned outboard thruster unit is described as being hydraulically powered, it will be apparent that electric power may be utilized in place of hydraulic power.

It should also be noted that a vessel may be provided initially with the mounting means of FIGS. 1–7 without requiring drydocking of such vessel. When the vessel is in drydock, the T-track mounting means of FIGS. 8 and 9 may replace the original mounting means. The same propulsion unit is useable with both forms of mounting means.

Various modifications and changes may be made with respect to the foregoing detailed description without departing from the spirit of the present invention.

I claim:

1. Outboard thruster apparatus for use on a marine vessel, said apparatus comprising:

a power-driven propulsion unit which when submerged provides thrust;

support means carrying said propulsion unit;

mounting means associated with the bow area of said vessel, said mounting means including a pair of generally vertically extending guide cables disposed on opposite sides of the bow area of said vessel, and a pair of legs affixed at their front ends to said support means and extending rearwardly from said support means to a slidable engagement with said guide cables;

hoisting means on said vessel attached to said support means to raise and lower said support means and propulsion unit between a stowed position on said vessel and a submerged operative position; and steering means operatively interposed between said propulsion unit and said support means to direct the thrust provided by said propulsion unit in different horizontal directions relative to said vessel.

2. Outboard thruster apparatus as set forth in claim 1, wherein:

said support means includes a support plate that carries said propulsion unit for rotation about a vertical axis, and said support plate also carries a steering motor connected to said propulsion unit to effect such rotation.

3. Outboard thruster apparatus as set forth in claim 2, wherein:

said hoisting means includes a davit mounted on the deck of said vessel for movement between an upright operative position and a generally horizontal retracted stowed position on the deck of said vessel;

a power block carried by said davit; and hoisting lines controlled by said power block interposed between said vessel and said support means for raising and lowering said hoisting lines.

4. Outboard thruster apparatus as set forth in claim 1, wherein:

said hoisting means includes a davit mounted on the deck of said vessel for movement between an upright operative position and a retracted stowed position;

a power block carried by said davit; and hoisting lines controlled by said power block interposed between said vessel and said support means for raising and lowering said hoisting lines.

* * * * *